US008154470B2

(12) United States Patent
Chang et al.

(10) Patent No.: US 8,154,470 B2
(45) Date of Patent: Apr. 10, 2012

(54) ELECTRICAL CONNECTOR ASSEMBLY WITH ANTENNA FUNCTION

(75) Inventors: Jen-Jou Chang, Tu-cheng (TW); Yao-Pang Lu, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 729 days.

(21) Appl. No.: 12/231,520

(22) Filed: Sep. 2, 2008

(65) Prior Publication Data

US 2009/0079661 A1 Mar. 26, 2009

(30) Foreign Application Priority Data

Sep. 3, 2007 (CN) ..... 2007 2 0046922 U

(51) Int. Cl.
*H01Q 1/50* (2006.01)

(52) U.S. Cl. ..... 343/906; 343/700 MS; 343/841; 439/916

(58) Field of Classification Search ..... 343/702, 343/841, 906, 700 MS; 455/575.5; 439/916
See application file for complete search history.

(56) References Cited

U.S. PATENT DOCUMENTS

| | | | | |
|---|---|---|---|---|
| 6,184,834 | B1 * | 2/2001 | Utsumi et al. | 343/702 |
| 6,392,603 | B1 * | 5/2002 | Kurz et al. | 343/702 |
| 6,786,769 | B2 | 9/2004 | Lai | |
| 2002/0140621 | A1 * | 10/2002 | Harrison | 343/890 |
| 2004/0135733 | A1 * | 7/2004 | Chou et al. | 343/841 |
| 2008/0136716 | A1 * | 6/2008 | Annamaa et al. | 343/702 |

* cited by examiner

*Primary Examiner* — Dieu H Duong
(74) *Attorney, Agent, or Firm* — Wei Te Chung; Andrew C. Cheng; Ming Chieh Chang

(57) ABSTRACT

An electrical connector assembly (100) with antenna function comprising: an electrical connector (20) comprising a metal shell (21); a metal patch (30) connecting to the metal shell (20) and comprising a radiating element (32) and a connecting element (31); the connecting element connecting to the metal shell that serve as a grounding element; the radiating element, the connecting element, and the metal shell forming an antenna that serves as a medium for transmission and reception of electromagnetic signals.

6 Claims, 4 Drawing Sheets

ELECTRICAL CONNECTOR ASSEMBLY WITH ANTENNA FUNCTION

BACKGROUND OF THE INVENTION

1. Field of the Invention

The present invention relates to an electrical connector assembly, and more particularly to electrical connector assembly having antenna function.

2. Description of Prior Art

Personal computer technologies have been embraced in many portable electronics devices including: cellular telephones, personal data assistant (PDA), laptop computers, MP3 players, pen-drives, digital video cameras, as well as other mobile devices. Many of the portable electronic devices can be configured to operate with various peripheral devices such as a computer mouse, a computer-writing tablet, a digital camera, as well as others. Moreover, many of the portable electronic devices are also configured to interface with personal computers through a standard interface.

The need for standardization in computer related interfaces, as well as the need for high-speed communication interfaces has lead to the development of the universal serial bus (USB). The USB interface is a high-speed communication protocol that permits devices to communicate at data rates on the order of 48 Mb/s. A revised USB interface such as the USB 2.0 specification can operate at even higher speeds that are on the order of 480 Mb/s. The high speed USB interface has lead to widespread acceptance of external peripheral devices such as USB HDD systems, USB Ethernet devices, USB compact disk writing devices (e.g., CD/RW), as well as other devices.

Today, more and more electronic devices, such as personal computers, notebook computers, electronic appliances, and the like, are normally equipped with an internal antenna that serves as a medium for transmission and reception of electromagnetic signals, such as data, audio, image, and so on. PIFA (Planar Inverted-F Antenna) is a kind of mini antenna usually used in the electronic devices. PIFA has compact structure, light weight, perfect impedance match, desired horizontal polarization and vertical polarization, and is easy to achieve multi-frequency. So, more and more PIFAs are used in the electronic devices. Electrical connector assembly and the antenna of the traditional electronic devices are two separate components. Accordingly, the electrical connector and the antenna respectively occupy inner space of the electronic devices. However, electronic devices trend to miniaturization developing. For saving inner space of the electronic devices, many components being integrated is a question.

Hence, in this art, an electrical connector assembly with antenna function to overcome the above-mentioned disadvantages of the prior art will be described in detail in the following embodiment.

SUMMARY OF THE INVENTION

An object of the present invention is to provide an electrical connector assembly which has antenna function.

To achieve the aforementioned object, the present invention provides an electrical connector assembly with antenna function comprising: an electrical connector comprising a metal shell; a metal patch connecting to the metal shell and comprising a radiating element and a connecting element; the connecting element connecting to the metal shell that serve as a grounding element; the radiating element, the connecting element, and the metal shell forming an antenna that serves as a medium for transmission and reception of electromagnetic signals.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
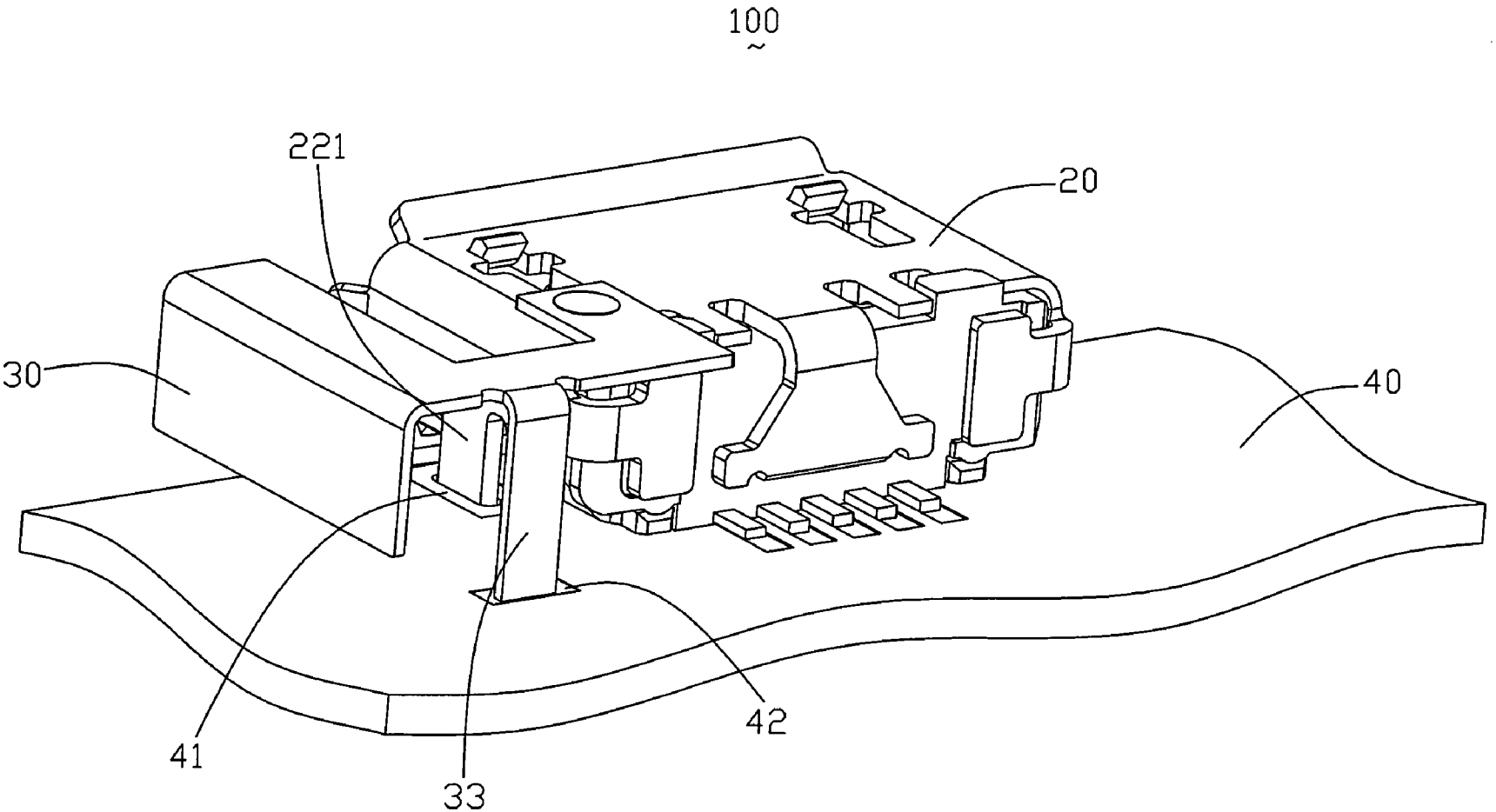
FIG. 1 is a perspective view of an electrical connector assembly with antenna in accordance with a preferred embodiment of the present invention.
Figure 2:
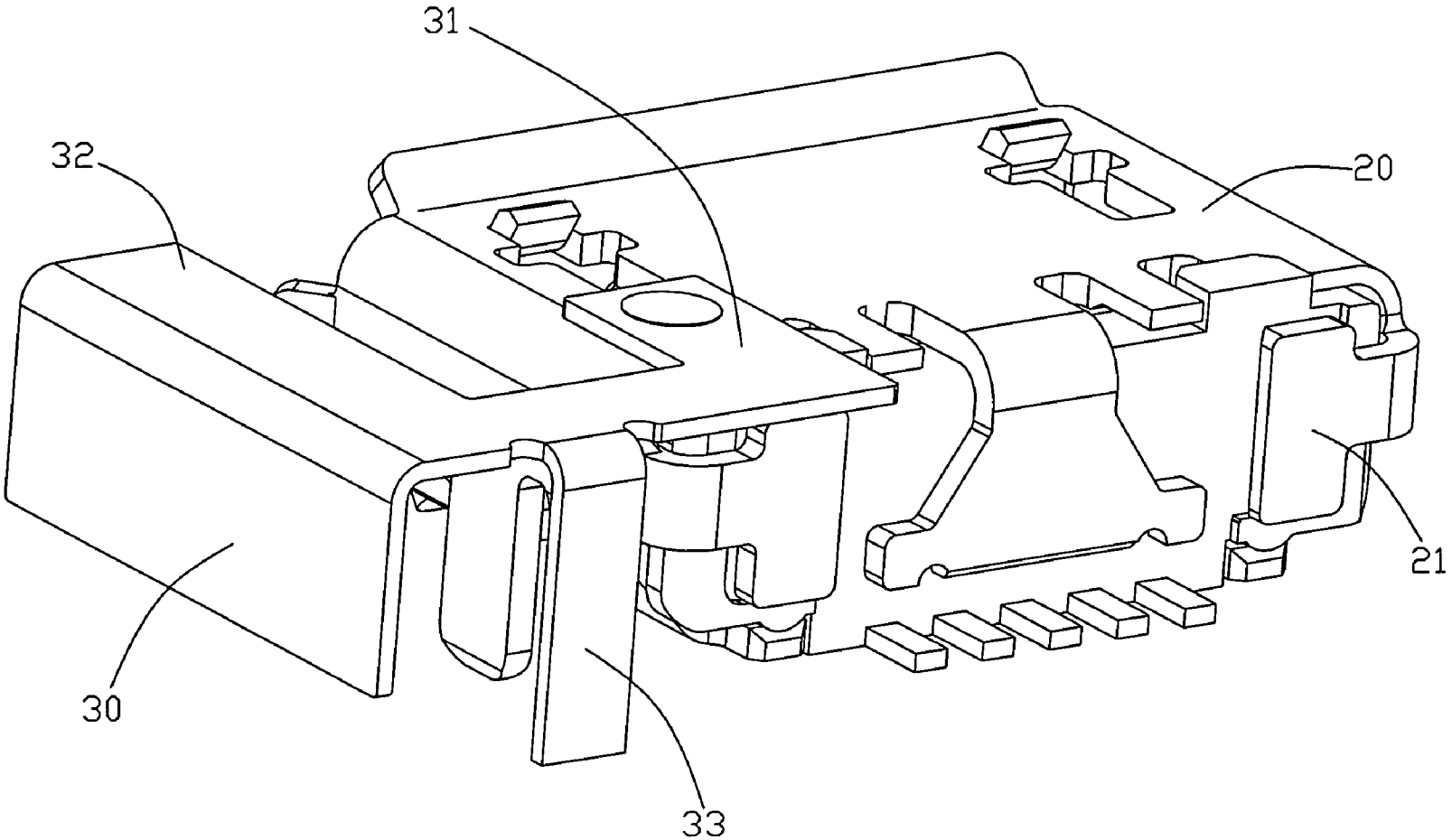
FIG. 2 is a perspective view of an electrical connector with a metal patch.
Figure 3:
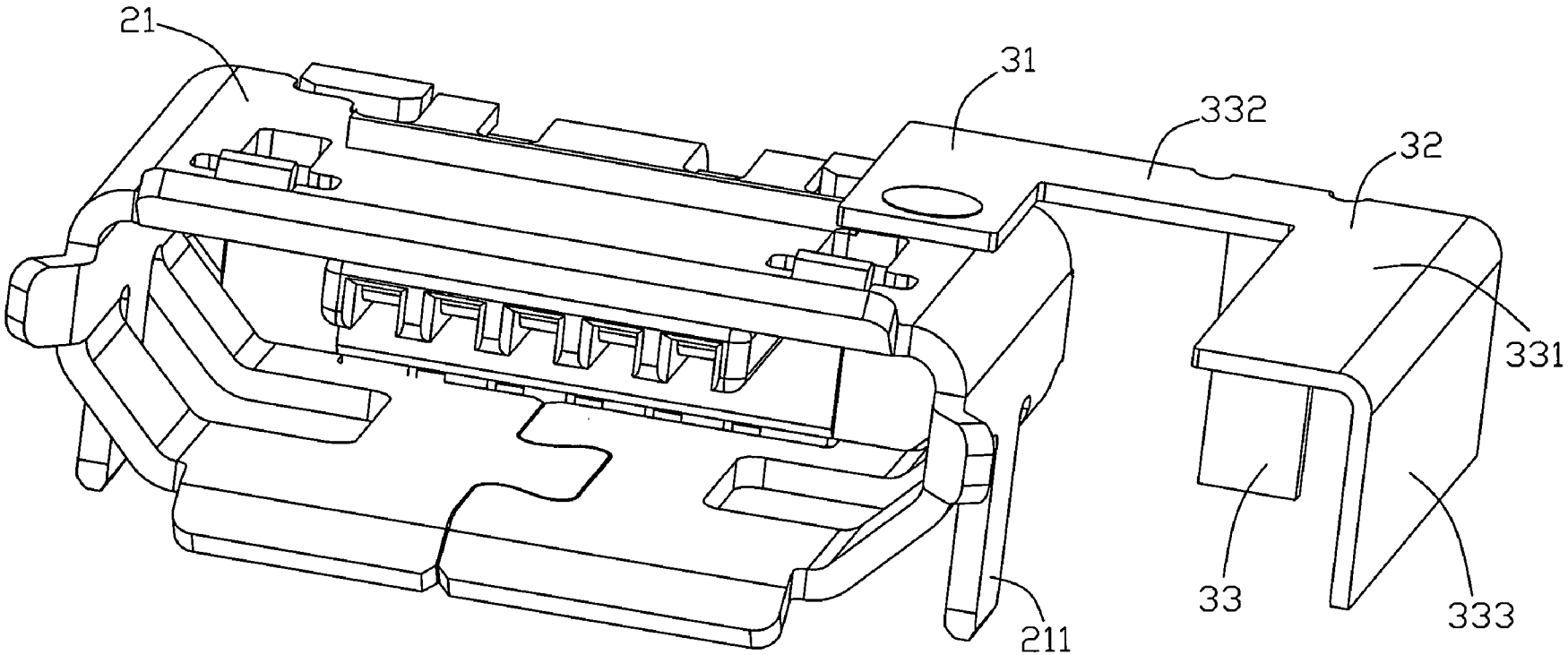
FIG. 3 is a view similar to FIG. 2, but from a different aspect.

Referring to FIGS. 1-3, an electrical connector assembly 100 with antenna function in accordance with a preferred embodiment of the present invention comprises a micro USB electrical connector 20, a metal patch 30, and a PCB 40.

The USB electrical connector 20 comprises an insulating body (not shown), several contacts (not shown) received in the insulating body, and a metal shell 21 covering the insulating body. The metal shell 21 comprises a welding element 211 extending vertically and downwardly from a bottom surface of the metal shell 21.

The metal patch 30 connects to the metal shell 21 of the USB connector 20. Accordingly, the metal patch 30 and the metal shell 21 forms an antenna that serves as a medium for transmission and reception of electromagnetic signals. The metal patch 30 comprises a connecting element 31 lying in a first plane and connecting to the metal shell 21, a radiating element 32 connecting to the connecting element 31, a feeding element 33 extending from a joint of the connecting element 31 and the radiating element 32. The radiating element 32 comprises a first rectangle-shape radiating branch 331, a second radiating branch 332 connecting the radiating branch 331 and the connecting element 31, and a third radiating branch 333 extending vertically from an end of the first radiating branch 331 in a second plane. The second radiating branch 332 is vertical to the first radiating branch 331 in the first plane. The feeding element 33 lies in a third plane. The first plane is vertical to the second plane, and the third plane is vertical to the first plane and the second plane respectively. The electrical connector assembly 100 is mounted on the PCB 40. The welding element 211 of the electrical connector 20 and the feeding element 33 are soldered respectively to suitable circuit of the PCB 40.

The PCB 40 comprises a pair of first slot 41 for receiving the welding element 211, a second slot 42 for receiving the feeding element 33, and feeding circuit and grounding circuit (not shown). The metal shell 21 electrically connects to the grounding circuit. The radiating element 32 electrically connects to the feeding circuit.

The electrical connector 20 of the present invention is not limited to the micro USB connector of the preferred embodiment, other types electrical connector as well as used in present invention, such as USB connector, HDMI connector, IEEE1394 connector and so on.

Figure 4:
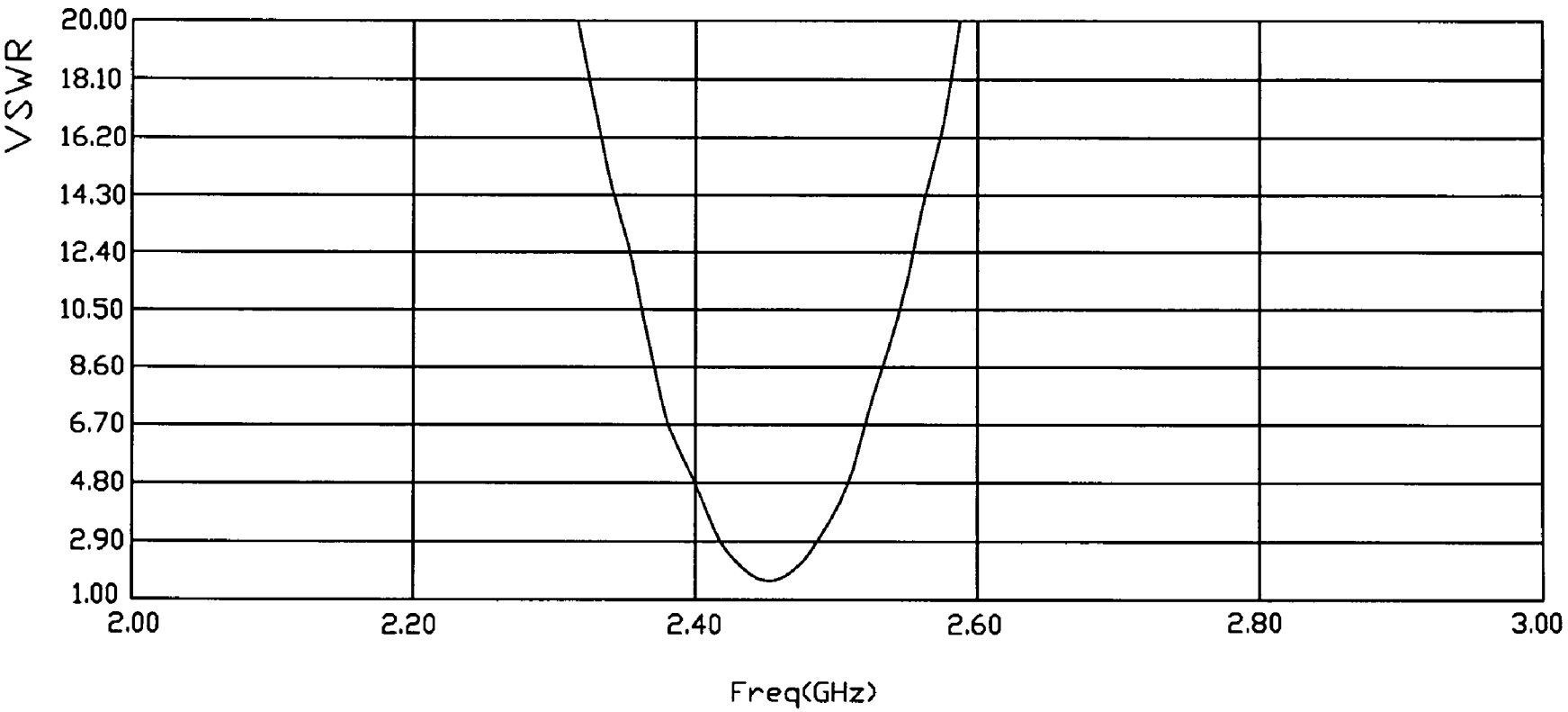
FIG. 4 is a test chart recording for the antenna of the in accordance with a preferred embodiment of the present invention, showing Voltage Standing Wave Ratio (VSWR) of frequency band.

FIG. 4 is a test chart of Voltage Standing Wave Ratio of the electrical connector assembly 100 as an antenna. Referring to FIG. 4, operating frequency band of the electrical connector assembly 100 as an antenna are 2.4 GHz-2.5 GHz.

What is claimed is:

1. An electrical connector assembly comprising:

an electrical connector including an insulative housing enclosed in a metallic shell, said shell including at least one mounting leg for mounting to a printed circuit board;

a plurality of contacts disposed in the housing and including mounting legs for mounting to the printed circuit board; and a metal patch positioned beside the connector and defining a connecting element electrically and mechanically connecting to the shell for grounding, at least one radiating element and one feeding element cooperating with said shell to commonly form an antenna unit; wherein the shell is configured to essentially intimately and compliantly shield the housing while substantial portions of said metal patch essentially extend away from the shell; wherein said metal patch defines first and second planes perpendicular to each other under a condition that the feeding element is located in the first plane, and the radiating element and the connecting element are located in the second plane; and wherein said metal patch further defines a third plane perpendicular to both said first and second planes under a condition another radiating element is located in the third plane.

2. The electrical connector assembly as claimed in claim 1, wherein said metal patch extends sidewardly beyond a longitudinal end of said connector in a longitudinal direction of said connector.

3. The electrical connector assembly as claimed in claim 1, wherein the feeding element extends downwardly longer than any other part of the metal patch so as to assure only said feeding element reaches the printed circuit board on which said connector is mounted.

4. The electrical connector assembly as claimed in claim 1, wherein said feeding element is located around a rear face of the connector.

5. The electrical connector assembly as claimed in claim 1, wherein said connecting element is engaged with a top wall of the shell.

6. The electrical connector assembly as claimed in claim 1, wherein the metal patch is discrete from the shell while being connected thereto for electrical transmission therebetween.

* * * * *